US009661899B2

(12) United States Patent
Marker et al.

(10) Patent No.: US 9,661,899 B2
(45) Date of Patent: May 30, 2017

(54) APPARATUS AND METHOD FOR APPLYING AN IMPREGNATING AGENT ONTO SURFACES OF ITEMS, IN PARTICULAR FOOTWEAR

(71) Applicant: IMBOX SHOECARE A/S, Egå (DK)

(72) Inventors: Rene Marker, Auning (DK); Per Bjerring, Risskov (DK)

(73) Assignee: IMBOX SHOECARE A/S, Torring (DK)

( * ) Notice: Subject to any disclaimer, the term of this patent is extended or adjusted under 35 U.S.C. 154(b) by 39 days.

(21) Appl. No.: 14/379,717

(22) PCT Filed: Mar. 3, 2014

(86) PCT No.: PCT/DK2014/050044

§ 371 (c)(1),
(2) Date: Aug. 19, 2014

(87) PCT Pub. No.: WO2014/135166

PCT Pub. Date: Sep. 12, 2014

(65) Prior Publication Data

US 2016/0037865 A1 Feb. 11, 2016

(30) Foreign Application Priority Data

Mar. 6, 2013 (DK) ..... 2013 70128

(51) Int. Cl.
*A43D 95/06* (2006.01)
*A43D 95/26* (2006.01)
(Continued)

(52) U.S. Cl.
CPC ..... *A43D 95/06* (2013.01); *A43B 7/12* (2013.01); *A43D 11/003* (2013.01); *A43D 95/26* (2013.01);
(Continued)

(58) Field of Classification Search
None
See application file for complete search history.

(56) References Cited

U.S. PATENT DOCUMENTS 1,181,835 A 5/1916 Burkhart

FOREIGN PATENT DOCUMENTS

DE 19 05 548 A1 10/1970
DE 16 85 433 B1 7/1971
(Continued)

OTHER PUBLICATIONS

International Search Report prepared by the European Patent Office on May 12, 2014, for International Application No. PCT/DK2014/050044.

(Continued)

*Primary Examiner* — Nathan T Leong
(74) *Attorney, Agent, or Firm* — Brent P. Johnson; Berg Hill Greenleaf Ruscitti LLP

(57) ABSTRACT

Apparatus for applying an impregnating agent onto surfaces of footwear at least comprising a right item and a left item, where said apparatus has a treatment chamber, where an openable and closable door is provided, said door allowing access to the interior of said treatment chamber for placing items to be impregnated inside said treatment chamber, and where adjacent the bottom of said treatment chamber means for placing the footwear at approximate determined positions are provided and where at least five nozzles are arranged in said treatment chamber, where said nozzles are able to create and issue a mist of impregnating agent, such that first and second nozzles are arranged to direct the mist to a zone of the footwear in the determined position corresponding to the front area of the right item respectively left item, and a third nozzle is positioned behind and between the determined position of the right item respectively left item,
(Continued)

which third nozzle directs the impregnating mist towards a zone of the footwear in the determined position corresponding to the rear and inside left and right sides of the right item respectively left item, and where the fourth and fifth nozzles are arranged behind the footwear in the determined position in order to direct impregnating mist towards the rear and outside left and right sides of the right item respectively left item.

13 Claims, 3 Drawing Sheets

(51) Int. Cl.

| | |
|---|---|
| ***A43D 119/00*** | (2006.01) |
| ***A43D 11/00*** | (2006.01) |
| ***B05B 15/12*** | (2006.01) |
| ***A43B 7/12*** | (2006.01) |
| ***B05B 12/02*** | (2006.01) |
| ***B05D 1/02*** | (2006.01) |
| ***B05D 3/00*** | (2006.01) |

(52) U.S. Cl.
CPC ..... *A43D 119/00* (2013.01); *B05B 12/02* (2013.01); *B05B 15/12* (2013.01); *B05B 15/1248* (2013.01); *B05D 1/02* (2013.01); *B05D 3/007* (2013.01)

(56) References Cited

FOREIGN PATENT DOCUMENTS

| | | | |
|---|---|---|---|
| GB | 546342 | A | 7/1942 |
| WO | WO 2009/127214 | A1 | 10/2009 |

OTHER PUBLICATIONS

Written Opinion prepared by the European Patent Office on May 12, 2014, for International Application No. PCT/DK2014/050044.
Search Report prepared by the Danish Patent Office on Oct. 16, 2013, for Danish Application No. PA 2013 70128.
International Preliminary Report on Patentability for International (PCT) Patent Application No. PCT/DK2014/050044, issued Sep. 8, 2015, 6 pages.

APPARATUS AND METHOD FOR APPLYING AN IMPREGNATING AGENT ONTO SURFACES OF ITEMS, IN PARTICULAR FOOTWEAR

CROSS REFERENCE TO RELATED APPLICATIONS

This application is a national stage application under 35 U.S.C. 371 and claims the benefit of PCT Application No. PCT/DK2014/050044 having an international filing date of Mar. 3, 2014, which designated the United States, which PCT application claimed the benefit of Danish Patent Application No. PA 2013 70128 filed Mar. 6, 2013, the disclosures of each of which are incorporated herein by reference.

FIELD OF THE INVENTION

The present invention relates to an apparatus for applying an impregnating agent onto surfaces of items, in particular footwear as well as a method of impregnating items such as footwear using an apparatus as mentioned before.

BACKGROUND OF THE INVENTION

In order to protect footwear or other items from moisture it is quite common to impregnate the footwear with an impregnating agent which will counteract the influence of moisture/water.

Within the context of this patent, footwear will be used as an example of items which are suitable to be treated with and by the invention. Naturally the skilled person will after having realised the advantages of the present invention recognise which other items the apparatus and method is suitable to treat as well.

Typically footwear will be made from a material which is not watertight, and as such one reason to impregnate is to prolong the period of time from the footwear is exposed to moisture and until the footwear is saturated whereby the moisture will have gained access to the feet.

Another object is to avoid moisture discolouring the surface and thereby the looks of the footwear which may also be alleviated by use of an impregnating agent.

Typically, the impregnating process is carried out by an impregnating agent contained in an aerosol can such that by activating the aerosol can an impregnating mist is created through the nozzle of the can and by directing the mist at the footwear, a layer of impregnating agent is applied to the surface of the footwear.

This process is typically carried out outside, in that the impregnating agent as well as the aerosols used to propel the impregnating agents have a bad smell and leave stains on the surroundings and if inhaled are potentially harmful to the health.

From DE19945229 is known an impregnating apparatus, where footwear is positioned on an endless conveyor and transported through various treatment sections. The conveyor belt comprises pushers which urge the footwear through the different sections and the footwear is positioned on turn-tables, such that as the footwear arrives at for example the impregnating spraying station, the footwear is rotated relative to the spraying nozzles, whereby the nozzles (in theory) impregnate all outside surfaces of the footwear.

In GB2125319 is disclosed a further apparatus for impregnating footwear. The apparatus comprises a rail on which rail the footwear to be impregnated is arranged. The track leads through treatment stations, and footwear placed on the tracks will when travelling through the treatment stations be sprayed with for example an impregnating agent, dried etc. The footwear is arranged on holders being part of the track, where the holders rotate in the treatment stations assuring that all outside surfaces are sprayed.

In order to address these issues the same applicant successfully developed an apparatus which had an enclosure into which footwear was placed and an impregnation procedure was carried out. This apparatus was published as international patent application no. WO 2009/127214 A1, and is incorporated by reference.

Although this apparatus did address the issues relating to hazardous inhalation of impregnating mist, distribution of impregnating agent in the environment and a more homogenous impregnation of footwear items, there were still some desirable improvement items which the present invention addresses.

OBJECT OF THE INVENTION

One of the objects of the present invention is therefore to create and apply a more homogenous and evenly distributed amount of impregnating agent on all surfaces of the footwear such that not only sufficient impregnating agent but also enough impregnating agent is evenly distributed on all exposed surfaces. Furthermore, it is desirable to use as little impregnating agent as possible, both with respect to environmental issues, but also with respect to the cost of impregnating footwear items. At the same time the apparatus must be compact and be able to treat various types and sizes of footwear, being made from different materials but still attain a finished result which is convincing and which will maintain the quality expected of an impregnated item.

DESCRIPTION OF THE INVENTION

The present invention addresses this by providing an apparatus for applying an impregnating agent onto surfaces of items, in particular footwear, where said apparatus has a treatment chamber, where an openable and closable door is provided, said door allowing access to the interior of said treatment chamber for placing item(s) to be impregnated inside said treatment chamber, and where adjacent the bottom of said treatment chamber means for placing the item(s), in particular footwear at approximate determined positions are provided and where at least three nozzles are arranged in said treatment chamber, where said nozzles are able to create and issue a mist of impregnating agent, such that first and second nozzles are arranged to direct the mist to a zone of the item(s) in the determined position corresponding to the right and left front area respectively and a third nozzle is positioned behind and between the determined position of the item(s), which third nozzle directs the impregnating mist towards a zone of the item(s) in the determined position corresponding to the rear and inside sides of the item(s).

In the context of at least the present invention it is important to understand the use of certain terms which will be used in the claims and also in the explanations below.

One such term is "impregnating agent". By impregnating agent is understood any usually liquid or gaseous substance which it is desirable to apply to a surface in order to obtain certain characteristics such as water repellence, colour, subtleness and the like. Examples may be silicon based water repellent impregnating agents, solvent containing fatty/oily substances or various colouring agents. With the present invention is has been found that agents having a particle size in the generated mist being 8-10 times smaller than water particles provided the best results. Likewise solvent containing agents having low points of ignition provided best results.

A further such term is "footwear". Traditionally, footwear is meant to indicate shoes, boots, sandals etc., but as will be obviously clear to the person skilled in the art any item which has a shape or size corresponding to footwear, and where it is desirable to provide a surface treatment should also be construed as being suitable to be treated or handled by an apparatus according to the present invention. Examples of such items are handbags, gloves, pillows etc.

Furthermore, the term "door" shall in the context of the present invention be construed as meaning any traditional door which has pivot means to allow it to be opened and closed, but furthermore as the purpose of the door is to allow access to a treatment chamber inside the apparatus, it is also contemplated within the scope of the present invention that the term door can in fact be understood as a drawer where the front of the drawer acts as a door, i.e. closes the access to the interior of the apparatus. In embodiments of the invention where the door is in the shape of a drawer the means for placing the footwear at approximately the determined position can suitably be arranged at the bottom of the drawer for convenience of use.

Furthermore, the term "mist" is to be understood as a relatively dense collection of miniscule droplets which are issued from nozzles. When the term "zone of the footwear" is used, this is to be understood as a part or section of a surface area of the footwear regardless of the relative orientation of that surface such that the surface may be vertical, horizontal or arranged at any angle in between, such that the nozzles being designated to provide spray in that zone will apply a mist of impregnating agent to any surface of the particular footwear present in that area/zone.

The door allows easy and safe access to the treatment chamber such that by opening the door it is possible to place the footwear inside the treatment chamber and by closing the door the treatment chamber will be sealed off from the exterior to such an extent that any harmful odours or particles from the impregnating process remain inside the apparatus. By furthermore indicating where footwear is to be positioned inside the treatment chamber by indicating the approximate determined positions of the footwear it is ensured that the footwear is placed at the correct distances relative to the nozzles such that a successful impregnating process may be achieved.

The term "approximate determined position" is to be understood such that as the apparatuses are being made for footwear of various sizes it is not always possible to have the same distance between the surface of the footwear to be treated and the specific nozzle. In order to compensate for this the apparatus comprises in a further advantageous embodiment software which will control one or more of the following parameters in order to obtain a successful impregnation: impregnating agent pressure, nozzle opening times, amount of impregnating agent used etc.

"Approximate determined position", may for example be an outline on the bottom of where to position each piece of footwear or a basket, or holder or other means suitable to retain/hold items to be treated in a substantially determined position relative to the nozzles positions in the treatment chamber.

Thorough investigation of the spray pattern of the present invention has indicated that although the nozzles for average size footwear will create an overlap in the issued mist, a thorough and complete impregnating cyclus will be achieved for a wide range of footwear sizes. However, it should be noted that for boots, shoes and sandals special impregnating routines are applied which will be discussed below with reference to the discussion of the inventive method of using the apparatus.

The impregnating routine is facilitated by providing at least three nozzles situated as described above such that all zones of the footwear are treated by a nozzle in the immediate vicinity. Tests have indicated that it is very important to have the distance between the surface to be treated and the nozzle outlet within a certain range in order to create a substantial mist which will be able to create a substantially homogenous mist at the point of contact with the surface of the item to be impregnated and at the same time avoid evaporation of especially solvents etc. before the impregnating agent has been transferred onto the zone to be impregnated.

In a further advantageous embodiment fourth and fifth nozzles are provided where the fourth and fifth nozzles are arranged behind the item(s) in the determined position in order to direct impregnating mist towards the rear and outside left and right sides of the right item respectively left item.

These fourth and fifth nozzles compliment the three nozzles to the effect that a complete and effective spray pattern is obtained, effectively covering any item arranged in the approximate determined position.

For these reasons and with respect to the shape of the footwear the nozzles may in a further advantageous embodiment be arranged at oblique angles relative to the bottom of the treatment chamber. By arranging the nozzles at oblique angles it is possible to arrange the nozzle such that they are optimally positioned relative to the surface of the footwear which is to be treated whereby the impregnating agent in mist-form is delivered to the surface in the most optimal manner.

In a still further advantageous embodiment of the invention each nozzle is connected to a reservoir of impregnating agent by means of a conduit, and that the impregnating agent is supplied under pressure to the nozzles, and where each nozzle is provided with a valve device, where each valve is controlled independently, and where at least the respective valves controlling first and second nozzles are controlled to issue impregnating agent at different times.

In this manner complete control of the mist creation is achieved and by controlling each valve and thereby each nozzle independently, it is possible to control the impregnating process completely.

Further advantages are obtained by controlling the nozzle such that the first and second nozzles issue at different times. As they are issuing from the left and right side of the footwear, some interference could arise from the mists being forced over the footwear whereby areas of the footwear could have agglomerations of impregnating agent whereas other areas would have almost no impregnating agent. By simply sequencing the mist generation in the nozzles, the nozzles will always issue into "unoccupied" space, i.e. issue into the air where no mist is present or travelling at that particular time.

In a further advantageous embodiment respective first and second nozzles issue impregnating agent in intervals of from 50 milliseconds to 2000 milliseconds, more preferred 100 milliseconds to 1500 milliseconds and most preferred 1500 milliseconds to 1300 milliseconds. With these short bursts which may be repeated as determined in the software it is ensured that the mist travelling towards the surface is not interfered/deflected during the travel, and that minute amounts of impregnating agent is used in each burst thereby making an economic process of the impregnating cyclus.

As already mentioned above the distance between the nozzles and the surfaces to be treated is rather important and as such the nozzles are arranged such that the distance, when shoes are positioned in the determined position, between the surfaces to be treated and the nozzles is from 10 mm to 200 mm, more preferred 25 mm to 100 mm.

In a still further advantageous embodiment extraction means are provided at the bottom of the treatment chamber, where said extraction means optionally may include an active filter unit, and where the extraction unit in use creates a relative under-pressure inside the chamber as compared to outside the apparatus.

As already mentioned above some of the impregnating agents may be hazardous to the health of operators or people in the vicinity of the apparatus and furthermore the impregnating agents may have an odour which is not desirable in the immediate vicinity, for example in a shop environment and therefore by providing extraction means optionally with active filter units it is possible to avoid any impregnating agent escaping the treatment chamber. Especially by arranging the extraction means such that a lower air pressure is present inside the air chamber than the ambient pressure in which the apparatus is placed it is ensured that there is no outflow of impregnating agent from the treatment chamber.

In a still further advantageous embodiment of the invention a sixth nozzle is arranged in an upper forward part of the treatment chamber, where said nozzle is directed for issuing impregnating agent towards a rear part of the treatment chamber.

This nozzle is specifically arranged in order to impregnate the shaft of boots and will typically only be activated by the software when a user selects an impregnating treatment relating to boots.

In a still further advantageous embodiment of the invention the apparatus comprises communicating means for communicating with a remote computer server, and where each time the apparatus is started and/or a spraying routine is activated, or at predetermined intervals the apparatus transmits one or more of the following to said remote server: an internal check report, contents/level(s) in reservoir(s), identification of spraying routines used, apparatus identification code, number of treatments, any errors.

These communicating means are provided in order to verify from a remote location the proper working of the machine as the apparatus is usually so complicated that the staff working in a shop where the impregnating apparatus is positioned will typically not be able to alleviate any failures, errors or breakdowns the apparatus should experience.

The invention is also directed at a method of impregnating footwear using an apparatus as discussed above. The inventive method carries out a number of steps wherein in a first step i. One shoe or a pair of shoes is placed inside the treatment chamber on the appropriate determined position as indicated on the bottom of the chamber;
ii. The chamber is closed and the impregnating process is initiated;
iii. Pump means connected to at least one reservoir comprising the impregnating agent and the nozzles inside the chamber, is activated, creating a pressure in the conduits leading from the pump to the nozzles;
iv. A pre-programmed spraying routine is executed by allowing a control unit in which control unit at least one spraying routine is pre-programme, to control the valves provided adjacent the nozzles to open and close according to the routine, and to activate the extraction means according to the spraying routine.

A further significant advantage with the apparatus and method, according to the invention is the fact that the apparatus may be built as a stand-alone unit, as all necessary features can be arranged inside one housing—as will be discussed below with reference to the figures. When issues relating to hazardous vapours, storage of impregnating agent etc. all are addressed and contained inside the apparatus, the apparatus may be placed in environments where prior art devices would not be suitable. Such environments include inside shops, dressing rooms, etc. where these types of apparatus are usually not allowed to be placed due to environmental issues.

With this method the inventive objects as already discussed above will be attained. Further advantageous embodiments of the method are described in further subclaims.

DESCRIPTION OF THE DRAWING

The invention will now be described with reference to the accompanying drawings wherein.

DETAILED DESCRIPTION OF THE INVENTION

Figure 1:
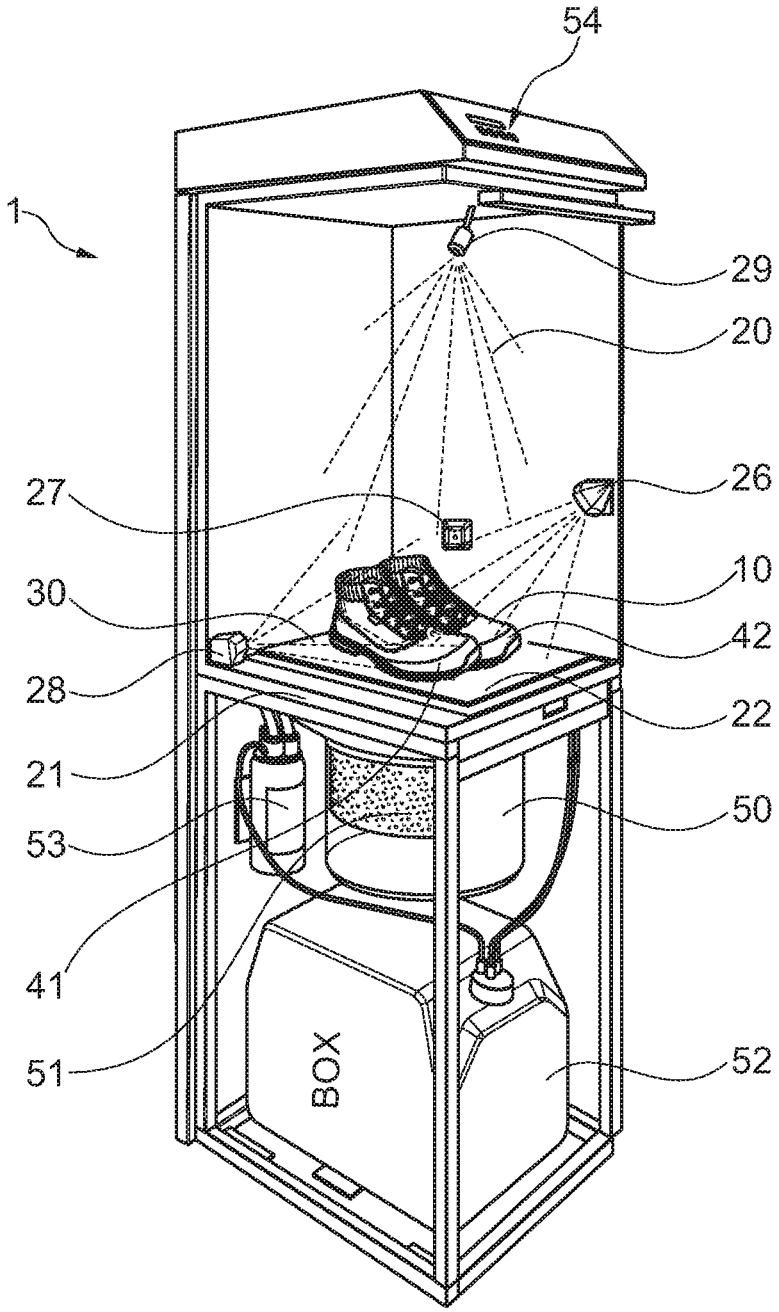
FIG. 1 illustrates schematically an apparatus for applying an impregnating agent onto surfaces of footwear.

In FIG. 1 is schematically illustrated an apparatus for applying an impregnating agent onto surfaces of footwear although the enclosing walls of the apparatus have been removed in order to be able to illustrate the proper working of the apparatus.

Figure 2:
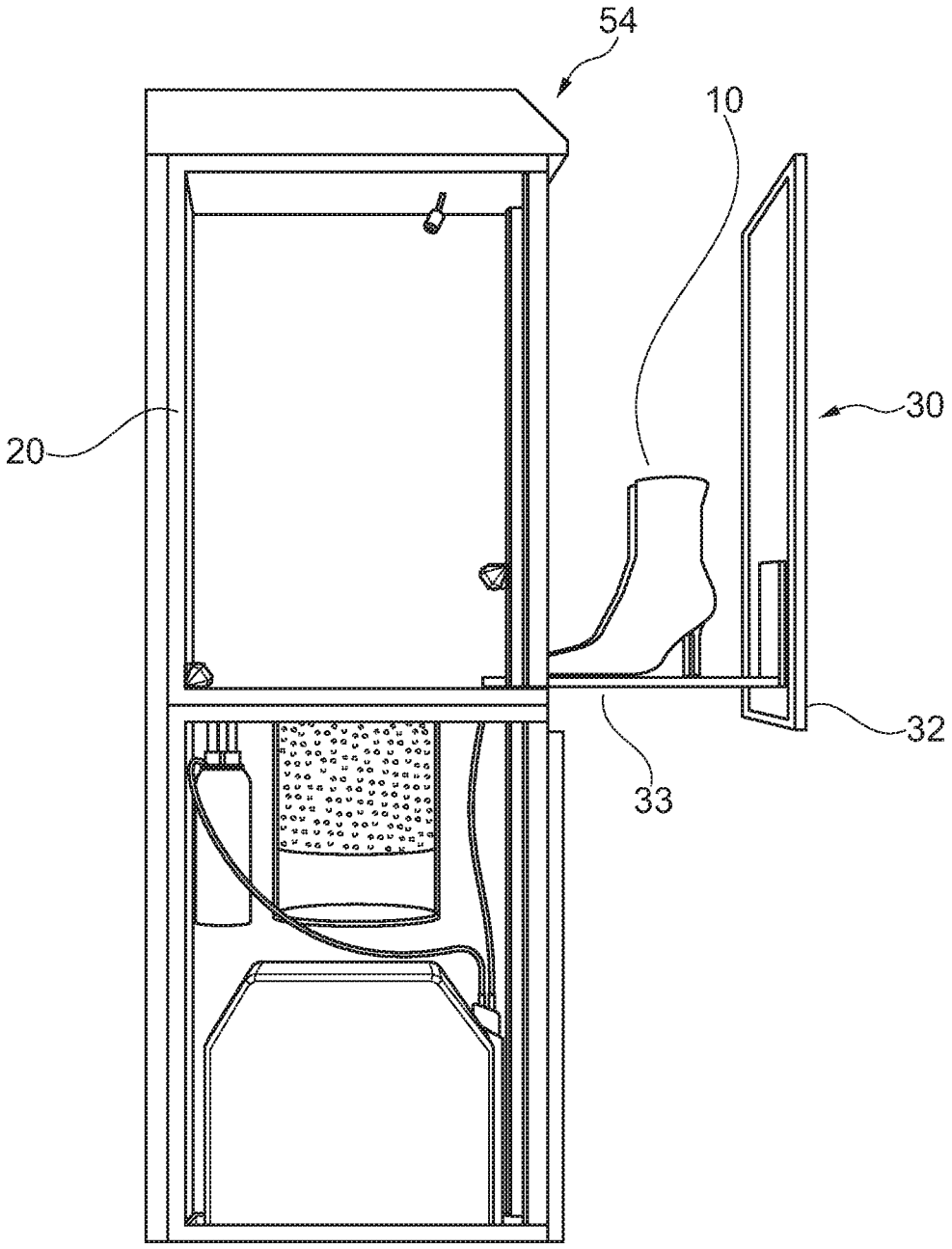
FIG. 2 illustrates a treatment chamber.

In the embodiment of the invention illustrated in FIG. 1 footwear is a pair of shoes 10 comprising a left and a right shoe. The shoes are arranged in a treatment chamber 20 which treatment chamber as illustrated in FIG. 2 may be opened and closed by means of a door 31 (see FIG. 2). The door 31 allows access to the interior of the treatment chamber 20 such that items as illustrated in FIG. 1 in the shape of a pair of shoes 10 may be placed and treated, i.e. impregnated inside the treatment chamber. Adjacent the bottom 21 of the treatment chamber 20, means in the shape of indications 22 for placing the footwear at approximate, determined positions, are provided.

Figure 3:
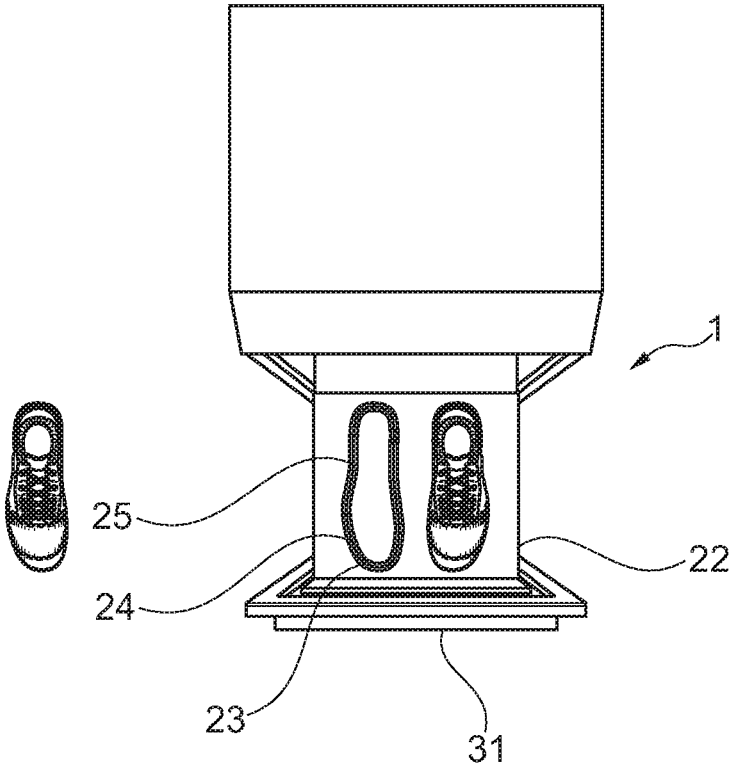
FIG. 3 illustrates the apparatus seen from above with the door pulled open.

Turning briefly to FIG. 3 the apparatus 1 is seen from above with the door 31 pulled open as illustrated in FIG. 2. In this view it is possible to see the means 22 for placing the footwear and furthermore the approximate determined positions are indicated by the outlines 23, 24, 25 corresponding to different shoe sizes. In this manner it is possible by placing the footwear to be treated at appropriate shoe sizes to place them at what within this application is called approximate determined positions.

Turning back to FIG. 1 a number of nozzles 26, 27, 28 and 29 are arranged inside the treatment chamber where each nozzle will create a mist of impregnating agent directed at the footwear 10 to be treated. The first and second nozzles 26, 27 are arranged to direct a mist to a zone 41, 42 of the footwear in the determined position corresponding to the front area of the right and left shoe respectively. A third nozzle 30 slightly obscured by the mist, is positioned behind and between the determined position of the right and left shoe respectively such that the third nozzle 30 directs the impregnating mist towards a zone of the footwear 10 in the determined position corresponding to the rear and inside left and right sides of the right and left shoe respectively. Fourth 28 and fifth nozzle (the fifth nozzle being obscured by the shoes) are arranged behind the footwear 10 in the determined position in order to direct the impregnating mist towards the rear and outside left and right sides of the right and left shoe respectively. In this manner the five nozzles 26, 27, 28, 30 (and the hidden fifth nozzle) substantially surround the shoes arranged in the approximate determined positions in the bottom part of the apparatus 1 and by issuing a mist created by passing an impregnating agent through the nozzles, the shoes are impregnated on substantially the entire outer surface.

Below the bottom 21 of the treatment chamber 20 is arranged various equipment. Immediately adjacent the bottom 21 and arranged in communication with the treatment chamber is a filter and extraction unit 50 which sucks out the surplus mist from the treatment chamber 20. The filter unit 51, for example being an active coal filter, neutralizes any odours. It is rather important that these types of machines are usually placed inside shops and the like, and therefore it is desirable that they are not noticeable in the immediate environment.

Lowermost in the apparatus 1 is arranged a container 52 containing the impregnating agent which by means of a pump 53 is guided to the nozzles in the treatment chamber 20. Each nozzle is provided with a valve (not illustrated) and each valve is controlled independently such that it is possible to activate the valves independently of each other. This is important due to the fact that the mist under pressure may create turbulence and "push" the mist issued from another nozzle away. By sequentially activating different nozzles it is ensured that the mist issuing from a determined nozzle will reach the footwear 10 arranged in the determined position. Furthermore, as is evident from FIG. 1 the nozzles are arranged at oblique angles such that they will spray slightly upwards or downwards onto the surfaces of the footwear in order to hit all surface areas of the footwear 10. The footwear 10 will typically not have all surfaces being perpendicular to the nozzles and therefore it is necessary to have the mist impregnate curved surfaces and by arranging the nozzles as illustrated a complete and satisfactory impregnation is achieved. In the upper part of the treatment chamber 20 a sixth nozzle 29 is arranged which sixth nozzle may be activated in order to impregnate items extending further up in the treatment chamber 20 such that for example boots, handbags and the like.

Turning to FIG. 2 the door 31 in the shape of a drawer comprises the closing front door surface 32 and the bottom of the drawer 33 onto which the means for indicating the approximate determined positions 22 are placed. When the footwear 10 is placed in the drawer and the drawer is shut closed, the treatment chamber is isolated from the outside.

As the impregnating cycle is activated by the control panel 54 the extraction unit 50 will ensure that underpressure relative to the ambient pressure outside the treatment is present inside the treatment chamber 20. In this manner it is ensured that the impregnating mist will not escape the treatment and that any odours will pass through the filter before being distributed back into the ambient environment.

The apparatus and method may for example be programmed to suitable routines depending on the size of the footwear. In table 1 are listed examples of spraying routines. Nozzles—numbers in brackets refer to reference numbers in FIG. 1, "small", "medium" etc relates to the size of the footwear and the numbers are spraying time in milli seconds.

| | Nozzle | | | | | |
|---|---|---|---|---|---|---|
| size | 1(26) | 2(27) | 3(28) | 4 | 5(30) | 6(29) |
| Small | 0 | 0 | 0 | 0 | 0 | 1300 |
| Medium | 600 | 600 | 400 | 400 | 150 | 0 |
| Large | 800 | 800 | 600 | 600 | 200 | 800 |
| Sandal | 150 | 150 | 0 | 0 | 0 | 150 |
| Boots | 600 | 600 | 600 | 600 | 400 | 600 |
| Bag | 150 | 150 | 150 | 150 | 0 | 150 |
| gloves | 200 | 200 | 0 | 0 | 150 | 200 |

The control panel contains all necessary input devices such that a user may operate the apparatus 1 for example by selecting an impregnating programme, as illustrated in table 1 for shoes as depicted in FIG. 1 where the sixth nozzle 29 is not activated or selecting a programme suitable for boots as illustrated in FIG. 2. Furthermore, the input may also be with respect to the material from which the footwear is made such that appropriate concentrations, mist densities etc. are generated by the nozzles. The software operating the impregnating cycle is designed to take care of most types of footwear regarding shape, size and material. After the impregnating cycle has been completed, a short drying cycle is activated such that as the footwear 10 is retrieved from the treatment chamber 20 by opening the door 30, the footwear will have a substantially dry surface being newly impregnated.

The control panel 54 and especially the software may also in further embodiments contain a GSM-module which communicates with a central server keeping track of the number of impregnating cycles, the amount of impregnating agent used and any error messages such that service may be carried out in good time.

The invention has been explained with reference to the accompanying drawings above depicting various aspects of embodiments of the invention, but the scope of protection shall not be limited to the embodiments described above, but be solely limited by the appended claims.

Above, and especially in the drawings the apparatus according to the invention has been described with reference to an apparatus which is clearly a stand alone self-contained unit. It may however also be considered to implement the advantageous features of the invention in production lines or other situations where the stand alone features are not necessary.

The invention claimed is:

1. Apparatus for applying an impregnating agent onto surfaces of footwear, where said apparatus has a treatment chamber, where an openable and closable door is provided, said door allowing access to the interior of said treatment chamber for placing footwear to be impregnated inside said treatment chamber, and where adjacent the bottom of said treatment chamber is means for placing the footwear at approximate determined positions and where at least three nozzles are arranged in said treatment chamber, where said nozzles are able to create and issue a mist of impregnating agent, such that first and second nozzles are arranged to direct the mist to a first zone of the footwear arranged in a determined position corresponding to the right and left front area of said footwear respectively, and a third nozzle is positioned behind and between the footwear in the determined position of the footwear, which third nozzle directs the impregnating mist towards a second zone of the footwear in the determined position corresponding to the rear and inside sides of the footwear, and further that each nozzle is connected to a reservoir of impregnating agent by means of a conduit, and that the impregnating agent is supplied under pressure to the nozzles, and where each nozzle is controlled by a programmed spraying routine for sequential and independent activation based on the determined positions of the footwear on the means for placing the footwear, and where at least the respective first and second nozzles are controlled to issue impregnating agent at different times to prevent interference between mists directed from the corresponding nozzles.

2. Apparatus according to claim 1, wherein further fourth and fifth nozzles are provided where the fourth and fifth nozzles are arranged behind the footwear in the determined position to direct impregnating mist towards the rear and outside sides of the footwear.

3. Apparatus according to claim 1 wherein the nozzles are arranged at oblique angles relative to the bottom of the treatment chamber.

4. Apparatus according to claim 3 wherein respective first and second nozzles are adapted to issue impregnating agent in intervals of from 50 milliseconds to 2000 milliseconds.

5. Apparatus according to claim 4 wherein respective first and second nozzles are adapted to issue impregnating agent in intervals of from 100 milliseconds to 1500 milliseconds.

6. Apparatus according to claim 4 wherein respective first and second nozzles are adapted to issue impregnating agent in intervals of from 1500 milliseconds to 1300 milliseconds.

7. Apparatus according to claim 1, wherein at least the nozzles are arranged on a common member, where said common member is moveable relative to the approximate determined position.

8. Apparatus according to claim 1 wherein the nozzles are arranged such that the distance, when shoes are positioned in the determined position, between the surfaces to be treated and the nozzles is from 10 mm to 200 mm.

9. Apparatus according to claim 8 wherein the nozzles are arranged such that the distance, when shoes are positioned in the determined position, between the surfaces to be treated and the nozzles is from 25 mm to 100 mm.

10. Apparatus according to claim 1, wherein extraction means are provided at the bottom of the treatment chamber, where said extraction means optionally may include an active filter unit, and where the extraction unit in use creates a relative under-pressure inside the chamber as compared to outside the apparatus.

11. Apparatus according to claim 1, wherein a sixth nozzle is arranged in an upper forward part of the treatment chamber, where said nozzle is directed for issuing impregnating agent towards a rear part of the treatment chamber.

12. Apparatus according to claim 1, wherein the apparatus comprises communicating means for communicating with a remote computer server, and where each time the apparatus is started and/or a spraying routine is activated or at predetermined time intervals, the apparatus is adapted to transmit one or more of the following to said remote server: an internal check report, contents/level(s) in reservoir(s), identification of spraying routine, apparatus identification code, number of cycles, error codes.

13. An apparatus for applying an impregnating agent onto surfaces of footwear comprising:

a treatment chamber having a door allowing access to an interior of said treatment chamber means for placing the footwear located adjacent a bottom of the treatment chamber, said means for placing corresponding to determined positions of the footwear;

at least three nozzles arranged in said treatment chamber to create and issue a mist of impregnating agent, wherein the first and second nozzles are arranged to direct the mist to a first zone of the footwear arranged in a determined position corresponding to the right and left front area of said footwear respectively, and a third nozzle is positioned behind and between the footwear in the determined position of the footwear, wherein the third nozzle directs the impregnating mist towards a second zone of the footwear in the determined position corresponding to the rear and inside sides of the footwear, wherein each nozzle is controlled by a programmed spraying routine for activation based on the determined position of the footwear located on the means for placing the footwear.

* * * * *